US007389726B2

(12) United States Patent
Ruoff et al.

(10) Patent No.: US 7,389,726 B2
(45) Date of Patent: Jun. 24, 2008

(54) DEVICE FOR PRODUCING PRINT IMAGES OF VARYING LENGTHS IN OFFSET PRINTING

(75) Inventors: Wolfgang Ruoff, Lörrach (DE); Stefan Beyersdorff, Steinen (DE)

(73) Assignee: Muller Martini Holding AG, Hergiswil (CH)

( * ) Notice: Subject to any disclaimer, the term of this patent is extended or adjusted under 35 U.S.C. 154(b) by 0 days.

(21) Appl. No.: 11/067,222

(22) Filed: Feb. 28, 2005

(65) Prior Publication Data

US 2005/0188866 A1 Sep. 1, 2005

(30) Foreign Application Priority Data

Feb. 27, 2004 (EP) ..... 04405119

(51) Int. Cl.
*B41F 13/44* (2006.01)

(52) U.S. Cl. ..... 101/216; 101/479

(58) Field of Classification Search ..... 101/479, 101/480, 216, 217
See application file for complete search history.

(56) References Cited

U.S. PATENT DOCUMENTS

| | | | | |
|---|---|---|---|---|
| 2,245,617 | A | 6/1941 | Stafford et al. | |
| 3,294,889 | A * | 12/1966 | Downie et al. | 264/255 |
| 3,606,835 | A | 9/1971 | Chambon | |
| 4,966,076 | A * | 10/1990 | John | 101/216 |
| 5,669,302 | A * | 9/1997 | Rogge et al. | 101/216 |
| 5,683,202 | A * | 11/1997 | Hummel et al. | 403/325 |
| 6,647,882 | B2 * | 11/2003 | Hofmann et al. | 101/479 |
| 6,718,876 | B1 * | 4/2004 | Williamsson | 101/479 |
| 7,011,022 | B2 * | 3/2006 | Motard et al. | 101/217 |
| 7,032,515 | B2 * | 4/2006 | Zimich et al. | 101/480 |

FOREIGN PATENT DOCUMENTS

| | | | |
|---|---|---|---|
| DE | 674 128 | C | 4/1939 |
| DE | 35 43 704 | A1 | 6/1987 |
| DE | 195 34 651 | A1 | 3/1997 |
| DE | 199 55 084 | A1 | 5/2001 |
| EP | 1 092 540 | A1 | 4/2001 |
| EP | 1 101 611 | A1 | 5/2001 |

* cited by examiner

*Primary Examiner*—Leslie J Evanisko
(74) *Attorney, Agent, or Firm*—Venable LLP; Robert Kinberg; Catherine M. Voorhees

(57) ABSTRACT

A device for producing print images of varying lengths in offset printing, said device comprises replaceable, cylindrical format sections with differing cylinder diameters. Each format section includes a support shaft with which the format section forms a single unit. The units are replaceable with one another to change print image length.

10 Claims, 2 Drawing Sheets

DEVICE FOR PRODUCING PRINT IMAGES OF VARYING LENGTHS IN OFFSET PRINTING

CROSS-REFERENCE TO RELATED APPLICATION

This application claims the priority of European Patent Application No. 04405119.1-1251, filed on Feb. 27, 2004, the disclosure of which is incorporated herein by reference.

BACKGROUND OF THE INVENTION

The invention relates to a device for producing print images of varying lengths in offset printing, the device comprising format sections with different cylinder diameters which can be exchanged for changing the print image length.

A device for producing print images of varying lengths in offset printing is known from German patent document DE 199 55 084 A. This device uses printing sleeves with a changeable diameter which are fitted onto cylinder cores and/or base cylinders for a full-rotation offset printing machine. The cylinder cores are positioned with both ends inside a frame, wherein one side of the frame is provided with a drive unit for the cylinder cores. The other side of the frame is used for the removal of the printing sleeves. The cylinder cores must take the form of air shafts, so that the printing sleeves can be fitted over the cylinder cores. The printing sleeves, which form the format sections, must be provided with a compressible layer on the inside surfaces, allowing the sleeves to be expanded somewhat and fitted over the air shaft. The disadvantage of these elastic and/or compressible layers, however, is that the high line forces generated in offset printing push the printing sleeves from the concentric position. This leads to changes in the adjustments and thus considerable printing problems. Air shafts and/or printing sleeves of this type have long been known in flexographic printing. However, since considerably lower pressure forces occur in the printing gap during flexographic printing, the aforementioned problems do not arise.

A further difficulty with this device is the torque transmission. The air shaft of known print units in offset printing has a specific diameter that is based on the smallest print length to be produced. For example, if this print length must start at approximately 350 mm (13.8" circumference), then the air shaft should have a maximum diameter of 105.158 mm. The same air shaft is also used for a print length of approximately 609 mm (24", D=194.04 mm). In that case, the air shaft diameter is not favorable and can lead to considerable problems in the printing sleeve composition and the torque transmission.

European patent document EP 1 101 611 A also relates to a device for producing print images of varying lengths in offset printing, wherein this device also has replaceable printing sleeves. These printing sleeves are positioned on pivoting arms. For the printing sleeve replacement, openings are worked into one of the two bearing plates through which the printing sleeves can be exchanged. However, the aforementioned problems also exist with this method and/or device.

German patent document DE 35 43 704 A relates to a device for imprinting a web. The sleeves in this case are also attached so as to be replaceable on a rotating body. A bearing plate can be folded down on the operating side for replacing the sleeves. However, producing such a fold-down bearing plate for an offset press is costly.

German patent document DE 19 53 4651 relates to a printing unit for indirect printing. For this, respectively one form cylinder and one transfer cylinder can be fitted for a variable circumference with so-called sleeves having variable outer diameters.

SUMMARY OF THE INVENTION

It is an object of the present invention to create a device where the aforementioned disadvantages are avoided.

The above and other objects are accomplished according to the invention by the provision of a device for producing print images of varying lengths in offset printing, the device comprising: replaceable, cylindrical format sections with differing cylinder diameters, each format section including a support shaft with which the format section forms a single unit, the units being exchangeable with one another to change print image length.

Thus, the foregoing object is solved in that the aforementioned format sections form a single unit together with respectively one support shaft and that the complete units are replaced for changing the print image length. To change the print image length for the device according to the invention, respectively a unit comprising a format section and a support shaft is therefore replaced, instead of only replacing the printing sleeve and/or the format section as has been the case so far. The main advantage of this design is that the support shaft can be very low-weight and that the elastic layer used so far on the inside of the format section can be omitted. In this way, the format sections can be fixedly connected to the support shaft to ensure a secure torque transmission and high form stability.

To change the print image length for the device according to the invention, at least one rigid unit that cannot be separated is replaced, wherein this unit consists of a format section and a support shaft.

The aforementioned units are preferably designed as either rubber blanket cylinders or plate cylinders. The invention furthermore has the advantage that the paper web is not interrupted for the change in the print image length.

According to a modification of the invention, the units can be installed and uninstalled essentially perpendicular to the rotational axis of a unit for such a replacement. The units are not inserted from the side through openings in a bearing plate, but rather are moved between the bearing plates, perpendicular to the rotational and/or the drive shafts. The main advantage of this design is that the bearing and drive parts can be positioned easier on the bearing plates and no pivoting bearing arms or fold-down bearing plates are required. The units can furthermore be exchanged manually since the support shafts, as previously mentioned, can be more light-weight, wherein the unit has a particularly low weight if the support shaft is hollow.

Yet another embodiment of the invention calls for the aforementioned units to be provided at the support shaft ends with respectively one pivot bearing with a separate outer bearing shell which can be replaced jointly with the unit. Since the units also comprise the respective pivot bearings which are provided with separate bearing shells, the replacement is particularly easy. For example, the pivot bearings can be fitted into shell halves which are respectively arranged on the inside of a bearing plate and can be clamped in. A particularly good rotational movement can be achieved with this type of positioning.

Additional advantageous features follow from the dependent patent claims, the specification, as well as the drawing.

BRIEF DESCRIPTION OF THE DRAWINGS

One exemplary embodiment is explained in the following with the aid of the drawing.

DETAILED DESCRIPTION OF THE PREFERRED EMBODIMENTS

Figure 1:
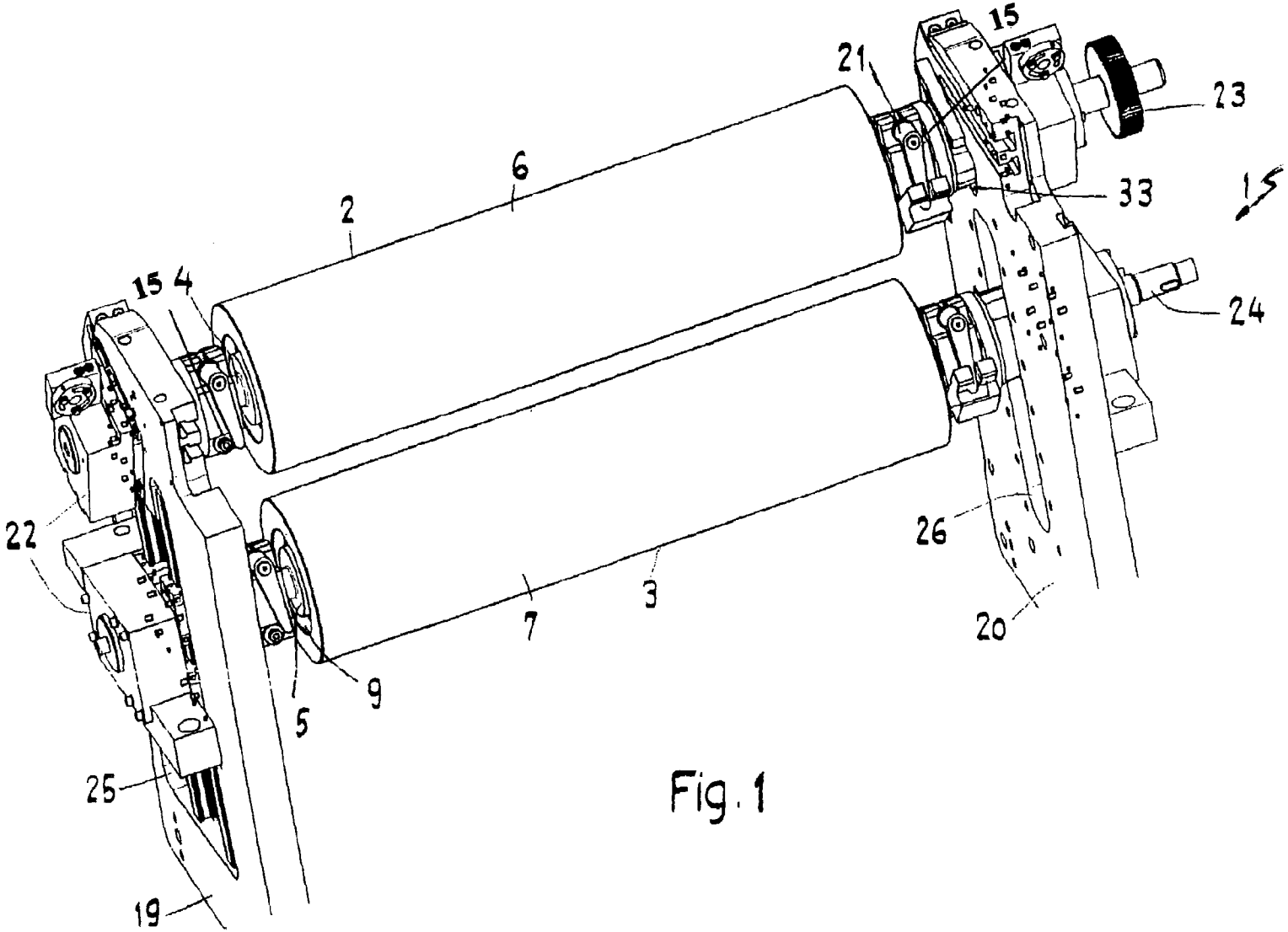
FIG. 1 shows a schematic perspective view of a device according to the invention, wherein known parts that are not essential to the invention are omitted.
Figure 2:
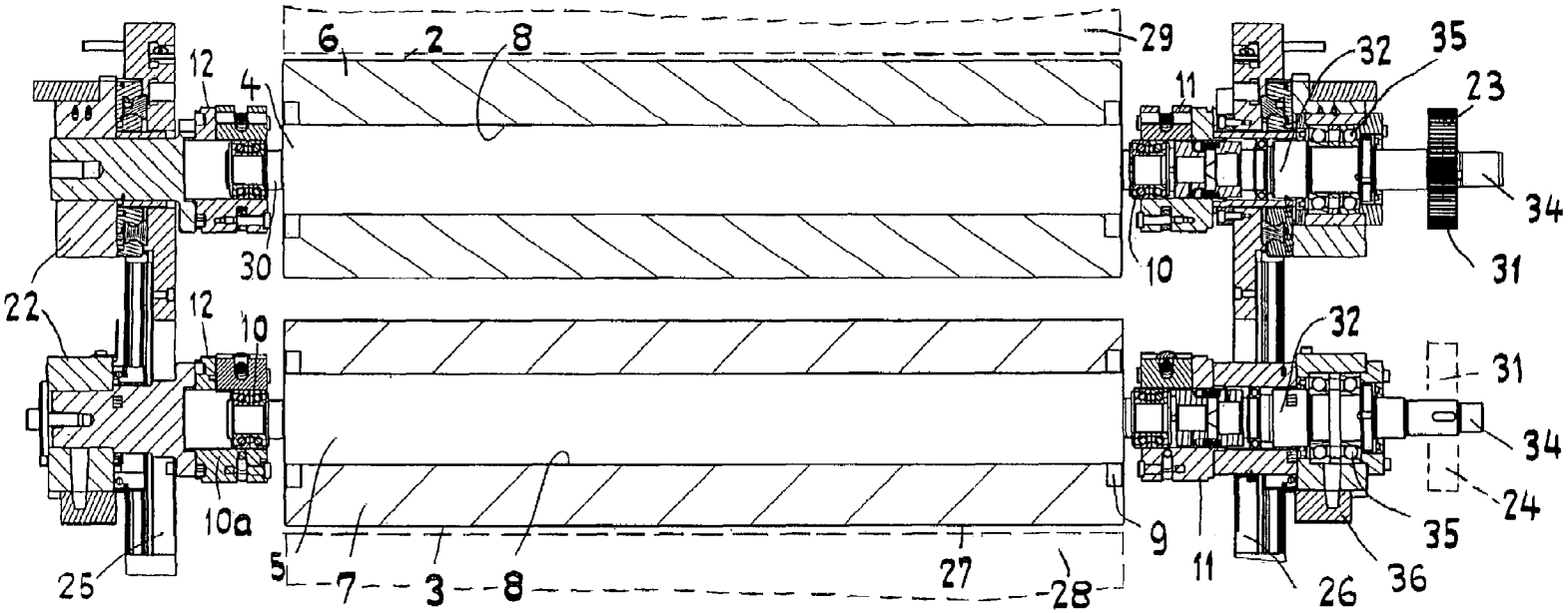
FIG. 2 is a section through the device according to FIG. 1.

Referring to FIG. 1, there is shown a device according to the invention, designed as slide-in unit 1 for a print unit, not shown herein, of an offset press. This slide-in unit 1 comprises a plate cylinder 2 and a rubber blanket cylinder 3 which are arranged between two bearing plates 19 and 20, arranged at a distance to each other. The plate cylinder 2 and rubber blanket cylinder 3 are positioned between bearing plates 19 and 20 with housings 22. Housings 22 positioned on either side of rubber blanket cylinder 3 are displaceable along guide slots 25 and 26 of bearing plates 19 and 20. The standard inking unit 29 and the counter pressure cylinder 28 are indicated in FIG. 2 with dashed lines. The counter pressure cylinder 28 and the inking unit 29 can have a known design and are therefore not described in further detail herein.

The plate cylinder 2 and the rubber blanket cylinder 3 respectively form a single unit, comprising a format section 6 and 7 and respective support shafts 4 and 5. For this, the format sections 6, 7 are provided with respectively one through bore 8 for accommodating the respective support shaft 4, 5. FIG. 2 shows an endless paper web 27 which normally moves between the rubber blanket cylinder 3 and the counter pressure cylinder 28 and is imprinted by both cylinders.

The support shafts 4 and 5 are respectively provided with a pivot bearing 10 on a journal 30 (FIG. 2), projecting outward on the side, for example a ball bearing or roller bearing or a different type of bearing with respectively one upright outer bearing shell 10*a*. The pivot bearings 10 are preferably fixedly mounted on the support shaft 4 and 5, thus also forming a fixed unit together with the respective support shafts 4 and 5 and the respective format sections 6 and 7. FIG. 2 shows that each pivot bearing 10 is positioned inside respective holding devices 11 on the right in FIG. 2 and respective holding devices 12 on the left in FIG. 2. The holding devices 11 and 12 for the plate cylinder 2 are positioned to be displaceable inside approximately horizontally extending guide slots 33 in the bearing plates 20 and 19, respectively, and can be displaced during a replacement, to adapt the axial spacing. However, these holding devices do not have to be displaceable. The two holding devices 11 and 12 for the rubber blanket cylinder 3 are positioned displaceable inside the respective guide slots 26 and 25 in the respective bearing plate 20 and 19. The rubber blanket cylinder 3 thus can be displaced inside guide slots 25 and 26. As a result, the axial spacing between the plate cylinder 2 and the rubber blanket cylinder 3 can be adjusted.

Drive shafts 31 are provided for the rotating operation of plate cylinder 2 (drive 23) and rubber blanket cylinder 3 (drive 24), having respectively one gearwheel 31 mounted thereon, which is not depicted. The drive shafts 34 are respectively positioned in roller bearings 35 in separate housings 36. For the torque transfer, the drive shafts 34 are connected via coupling mechanisms 32 to the respective support shafts 4 and 5.

Figure 3:
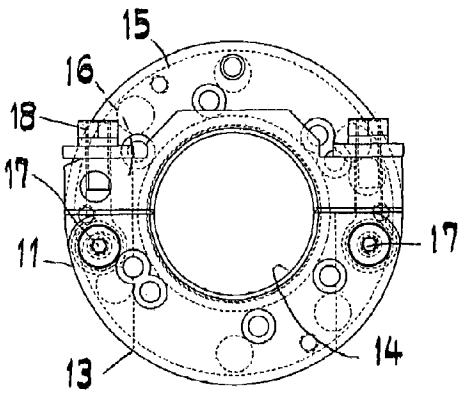
FIG. 3 is a view from the side of a unit with a holding device.

The holding devices 11 and 12 respectively consist of a lower half shell 13 and an upper half shell 15 as shown in FIG. 3. The lower half shells 13 are each securely connected by means of fastening screws 17 to one of the two bearing plates 19 and/or 20 and are each provided with a semicircular depression 14, which is open on the top and into which a pivot bearing 10 can be inserted from the top. The upper half shells 15 can respectively be tilted away or otherwise removed from the lower half shell 13. If the two upper half shells 15 are tilted away, then the plate cylinder 2 and the rubber blanket cylinder 3 with the corresponding pivot bearings 10 can be inserted from the top into the lower half shells 13. The outer bearing shells 10*a* are secured in place by screwing the upper half shells 15 with screws 18 to the lower bearing shells 13. Recesses 16 are provided in the shell halves 15 for the screws 18. As shown in FIG. 1, the screws 18 can respectively be provided with a tension lever 21. Prior to securing the pivot bearing 10 in place, the plate cylinder 2 and the rubber blanket cylinder 3 in FIG. 2 are moved in an axial direction somewhat to the right, so that the support shafts 4 and 5 are connected to the corresponding drive shaft 34.

For the removal of the plate cylinder 2 and/or the rubber blanket cylinder 3, the cylinder is displaced somewhat to the left for releasing the respective coupling mechanism 32 and for removing the upper half shell 15, as shown in FIG. 2. Once the half shells 15 are tilted away, the plate cylinder 2 and/or the rubber blanket cylinder 3 can be lifted out by means of the recessed grips 9.

The support shafts 4 and 5 are respectively connected securely to format sections 6 and 7 to ensure in each case a safe torque transfer from the support shafts 4 and 5 to the respective format sections 6 and 7 as well as high form stability. The connection between support shaft 4 and 5 and the respective format section 6 and 7 in particular can be form-locking, e.g. if the support shafts 4 and 5 are non-round and are inserted into a correspondingly non-round passage of the format section 6 and 7. However, other types of connections are conceivable as well.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for producing print images of varying lengths in offset printing, said device comprising:

replaceable, cylindrical format sections with differing cylinder diameters, each format section including a support shaft having ends that project from the format section with which the format section forms a single format section unit, each of the format section units being replaceable with another one to change print image length;

two bearing plates arranged at a distance to each other, wherein the ends of the respective format section units are positioned on the inside of the bearing plates;

a holding device arranged on each respective bearing plate, each holding device being provided with a depression for receiving a respective end of a support shaft of each format section unit so that the format section units are dismantleable and installable between the two bearing plates in a substantially perpendicular movement with respect to their respective support shafts; and displaceable housings disposed on the outside of the respective bearing plates wherein the two bearing plates have guide slots and the respective holding device is secured to the displaceable housing so that the holding devices are displaceable on the inside of the bearing plates.

2. The device according to claim 1, wherein each format section is connected inseparably to its support shaft.

3. The device according to claim 1, wherein each format section unit comprises one of a rubber blanket cylinder or a plate cylinder.

4. The device according to claim 1, further including respectively one pivot bearing with at least one outer bearing shell arranged on each end of the support shaft, the respective one pivot bearing being accommodated in the depression of the respective holding device.

5. The device according to claim 4, wherein at least one of the holding devices includes a lower half shell that is provided with the depression.

6. The device according to claim 5, wherein the at least one holding device further includes an upper half shell and the respective one pivot bearing is secured in the depression of the holding device via the upper half shell.

7. The device according to claim 1, wherein at least one of-said support shafts has a hollow-cylindrical design.

8. The device according to claim 1, wherein the format section units include a recessed grip on each end of the respective format section.

9. The device according to claim 1, wherein the format section units each take the form of a slide-in unit for an offset press.

10. A device for producing print images of varying lengths in offset printing, said device comprising:

replaceable, cylindrical format sections with differing cylinder diameters, each format section including a support shaft having ends that project from the format section with which the format section forms a single format section unit, each of the format section units being replaceable with another one to change print image length;

two bearing plates arranged at a distance to each other, wherein the ends of the respective format section units are positioned on the inside of the bearing plates;

a holding device arranged on each respective bearing plate;

a pivot bearing arranged on each end of the support shaft where each holding device is provided with a depression for receiving a respective pivot bearing so that the format section units are dismantleable and installable between the two bearing plates in a substantially perpendicular movement with respect to their respective support shafts; and displaceable housings disposed on the outside of the respective bearing plates wherein the two bearing plates have guide slots and the respective holding device is secured to the displaceable housing so that the holding devices are displaceable on the inside of the bearing plates.

* * * * *